US009692098B2

(12) United States Patent
Subedi et al.

(10) Patent No.: US 9,692,098 B2
(45) Date of Patent: Jun. 27, 2017

(54) MULTI RESONATOR NON-ADJACENT COUPLING

(71) Applicant: Intel Corporation, Santa Clara, CA (US)

(72) Inventors: Purna Subedi, Irvine, CA (US); Ian Burke, Lake Forest, CA (US); Vien Van Tran, Bedford, NH (US)

(73) Assignee: Intel Corporation, Santa Clara, CA (US)

( * ) Notice: Subject to any disclaimer, the term of this patent is extended or adjusted under 35 U.S.C. 154(b) by 83 days.

(21) Appl. No.: 14/500,440

(22) Filed: Sep. 29, 2014

(65) Prior Publication Data

US 2015/0091672 A1 Apr. 2, 2015

Related U.S. Application Data

(60) Provisional application No. 61/883,706, filed on Sep. 27, 2013.

(51) Int. Cl.

| | |
|---|---|
| ***H01P 1/205*** | (2006.01) |
| ***H01P 1/208*** | (2006.01) |
| ***H01P 1/04*** | (2006.01) |
| ***H01P 7/04*** | (2006.01) |

(52) U.S. Cl.

CPC ..... *H01P 1/2053* (2013.01); *H01P 1/208* (2013.01); *H01P 7/04* (2013.01)

(58) Field of Classification Search

CPC ..... H01P 1/205; H01P 1/2053; H01P 7/04; H01P 1/208

USPC ..... 333/206, 207, 222, 223, 204, 205, 219, 333/235

See application file for complete search history.

(56) References Cited

U.S. PATENT DOCUMENTS 5,262,742 A 11/1993 Bentivenga
5,748,058 A 5/1998 Scott
(Continued)

FOREIGN PATENT DOCUMENTS

CN 105556839 A 5/2016
DE 2218277 A1 10/1973
(Continued)

OTHER PUBLICATIONS

Wang et al, "True Inline Cross-Coupled Coaxial Cavity Filters", Dec. 2009, IEEE, vol. 57, pp. 2958-2965.*
(Continued)

*Primary Examiner* — Benny Lee
*Assistant Examiner* — Jorge Salazar, Jr.
(74) *Attorney, Agent, or Firm* — Schwegman Lundberg & Woessner, P.A.

(57) ABSTRACT

A coupling is provided for coupling non-adjacent resonators of a radio frequency filter. The coupling joins together non-adjacent resonators with a metal strip. The metal strip is physically connected to but electrically isolated from resonators located between the connected non-adjacent resonators. The metal strips include tabs the length of which may be varied. The coupling works with different resonator configurations including horizontally aligned resonators. The coupling allows for the jumping of an even number of resonators can produce zeros at high and low bands. A single coupling of this configuration enables two negative couplings.

12 Claims, 6 Drawing Sheets

(56) References Cited

U.S. PATENT DOCUMENTS

| | | | | |
|---|---|---|---|---|
| 6,262,639 | B1 * | 7/2001 | Shu | H01P 1/2084 333/202 |
| 6,664,872 | B2 | 12/2003 | Channabasappa et al. | |
| 2002/0070820 | A1 | 6/2002 | Walker et al. | |
| 2007/0273459 | A1 * | 11/2007 | Puoskari | H01P 1/209 333/206 |
| 2010/0029241 | A1 | 2/2010 | Morga et al. | |
| 2014/0292446 | A1 | 10/2014 | Chiu et al. | |

FOREIGN PATENT DOCUMENTS

| | | | |
|---|---|---|---|
| EP | 0069651 | A1 | 1/1983 |
| FR | 2509535 | A1 | 11/1983 |
| WO | WO-2015048650 | A1 | 4/2015 |

OTHER PUBLICATIONS

"International Application Serial No. PCT/US2014/058053, International Search Report mailed Jan. 9, 2015", 2 pgs.
"International Application Serial No. PCT/US2014/058053, Written Opinion mailed Jan. 9, 2015", 4 pgs.
"International Application Serial No. PCT/US2014/058053, International Preliminary Report on Patentability mailed Apr. 7, 2016", 6 pgs.
"European Application Serial No. 14849074.1, Extended European Search Report mailed Mar. 31, 2017", 7 pgs.
"U.S. Appl. No. 15/452,186, Non Final Office Action mailed May 8, 2017", 13 pgs.
Thomas, Brain J, "Cross-Coupling in Coaxial Cavity Filters—A Tutorial Overview", IEEE Transaction on Microwave Theory and Techniques, vol. 51, (Apr. 8, 2003), 1368-1376.

* cited by examiner

MULTI RESONATOR NON-ADJACENT COUPLING

BACKGROUND OF THE INVENTION

1. Field of the Invention

The present invention relates to resonators. More particularly, the present invention relates to couplings among a plurality of resonators. Still more particularly, the present invention relates to coupling between or among non-adjacent resonators.

2. Description of the Prior Art

Non-adjacent coupling between resonators in RF filters is a widely established technique to achieve transmission zeros at desired frequencies and thus establish sharp rejections in certain frequency ranges without increasing the number of resonators. Most of the real world applications require non-symmetrical frequency response; i.e., one side of the frequency band has much higher rejection requirements than the other and thus the ability to place transmission zeros arbitrarily at desired frequencies can produce both symmetric and non-symmetric frequencies. This very ability allows us to reduce filter sizes while minimizing, insertion loss and at the same time increasing rejections in desired frequencies. Some of the techniques to couple non-adjacent cavities are to bring non-adjacent cavities physically closer, but this approach may not always be possible or be impractically difficult due to geometry constraints.

SUMMARY OF THE INVENTION

The present invention mitigates the problem of coupling together non-adjacent resonators including in situations with geometric constraints. It does so by providing a configuration that enables the coupling of non-adjacent cavities including, but not limited to, when the cavities am arranged in straight lines.

In one embodiment, the present invention is a radio frequency (RF) filter including three or more resonators, the RF filter comprising a coupling contacting a first of the three or more resonators and a second of the three or more resonators, wherein the first and the second resonator are not adjacent to one another, and wherein the coupling is connected to but electrically isolated from each resonator of the three or more resonators positioned between the first and second resonators. The coupling includes a metal strip in physical contact with a surface of the first resonator and a surface of the second resonator and a non-conductive spacer between the metal strip and a surface of each resonator of the three or more resonators positioned between the first and second resonators. The thickness of the spacer is selectable. The metal strip includes one or more tabs for contacting the first and second resonators. The lengths of the tabs are selectable. The metal strip may contact the first and second resonators at a selectable location thereon.

In another embodiment, the invention is a RF filter including five or more resonators, the RF filter comprising a first coupling contacting a first of the five or more resonators and a second of the five or more resonators, wherein the first and the second resonator are not adjacent to one another, and wherein the first coupling is connected to but electrically isolated from each resonator of the five or more resonators positioned between the first and second resonators, and a second coupling contacting the second resonator and a third of the five or more resonators, wherein the second and third resonator are not adjacent to one another, and wherein the second coupling is connected to but electrically isolated from each resonator of the five or more resonators positioned between the second and third resonators. The first coupling includes a first metal strip in physical contact with a surface of the first resonator and a surface of the second resonator and a non-conductive spacer between the metal strip and a surface of each resonator of the five or more resonators positioned between the first and second resonators, and wherein the second coupling includes a second metal strip in physical contact with the surface of the second resonator and a surface of the third resonator and a non-conductive spacer between the second metal strip and a surface of each resonator of the five or more resonators positioned between the second and third resonators. The thickness of each of the spacers is selectable. The first metal strip includes one or more tabs for contacting the first and second resonators and the second metal strip includes one or more tabs for contacting the second and third resonators. The lengths of the tabs are selectable. The first metal strip may contact the first and second resonators at a selectable location thereon and the second metal strip may contact the second and third resonators as a selectable location thereon.

The features and advantages of the invention will become further apparent upon review of the following detailed description, the accompanying drawings and the appended claims that describe the invention.

DETAILED DESCRIPTION OF THE INVENTION

Figure 1A:
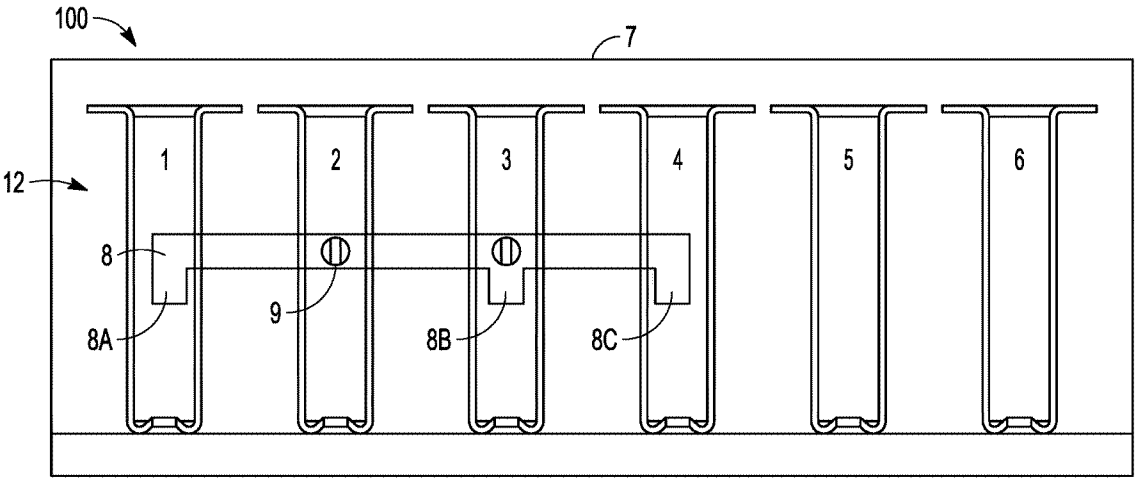
FIG. 1A is a front view of a multi resonator filter with a first embodiment of the coupling of the present invention showing a set of six resonator cavities and a single coupling element.
Figure 1B:
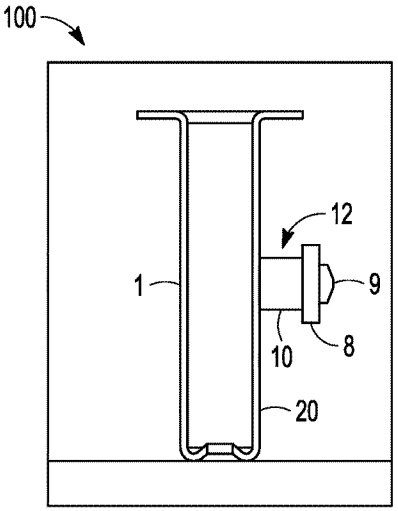
FIG. 1B is a side view of the multi resonator filter of FIG. 1A.

In reference to FIGS. 1A and 1B, a multi resonator filter 100 includes a set of six resonators, resonators 1-6, that are metal resonators with resonator cavities either forming part of resonator housing 7 or that are mechanically bolted or bonded to the housing 7. The housing 7 may be a metal housing. The filter 100 further includes a first embodiment of a coupling 12 that is formed of a metal strip 8 and non-conductive (dielectric) spacers 10 fastened together with non-conductive (dielectric) screws 9. The spacers 10 space the metal strip 8 from a surface 20 of the resonators 2 and 3. That is, the configuration of coupling 12 couples resonators 1 and 4 and allows the jumping in doing so of resonators 2 and 3.

The present invention, works with any resonator configuration; however, it is more practical when the resonators are laid out horizontally, i.e., the resonators are accessible from the sides normally with a removable side cover of the housing 7.

Normally, a positive coupling between two resonator cavities jumping an odd number of cavities produces a zero in the high side of the band and a negative coupling produces a zero in the low side of the band. But, in the case of a negative coupling using the coupling 12 of the present invention, jumping an even number of resonators, i.e., coupling from resonator 1 to resonator 4 (thereby jumping the two resonators 2 and 3), can produce two zeros, one at the lower side of the band and the other at the higher side of the band. With this even resonator jumping negative cross coupling, the level of zeros on each side of the band can be grossly differently with only one side of the zero being fully controllable for the frequency position. Placing another negative coupling from resonator 1 to 2 (or 2 to 4), enables control of the placement of zeros at the lower side of the bands. Similarly, placing a positive coupling from resonator (1 to 2 (or 2 to 4)), enables control of the higher side zero. This ability allows to fully control both side of the zeros. Normally, having two negative couplings requires two cross coupling elements. That is not necessary with the present invention.

Normally, when the distance between resonators is less than one-quarter wavelength, an open ended transmission line that is a certain distance away from the resonator that is cross coupled produces a negative coupling and physically shorting each end to the resonator that is being coupled will produce a positive coupling. In the configuration of the invention shown in FIGS. 1A and 1B, just the one metal strip 8 produces non adjacent negative coupling between resonators 1 to 3 and (also 2 to 4) while also producing a negative coupling between resonators 1 and 4. The tab lengths 8*a*, 8*b* and 8*c* are of selectable length, allowing for the tuneability of respective coupling values. The filter tuneability can also be managed by placing the metal strip 8 either towards the top or the bottom of the surface 20 of the resonators.

Figure 2:
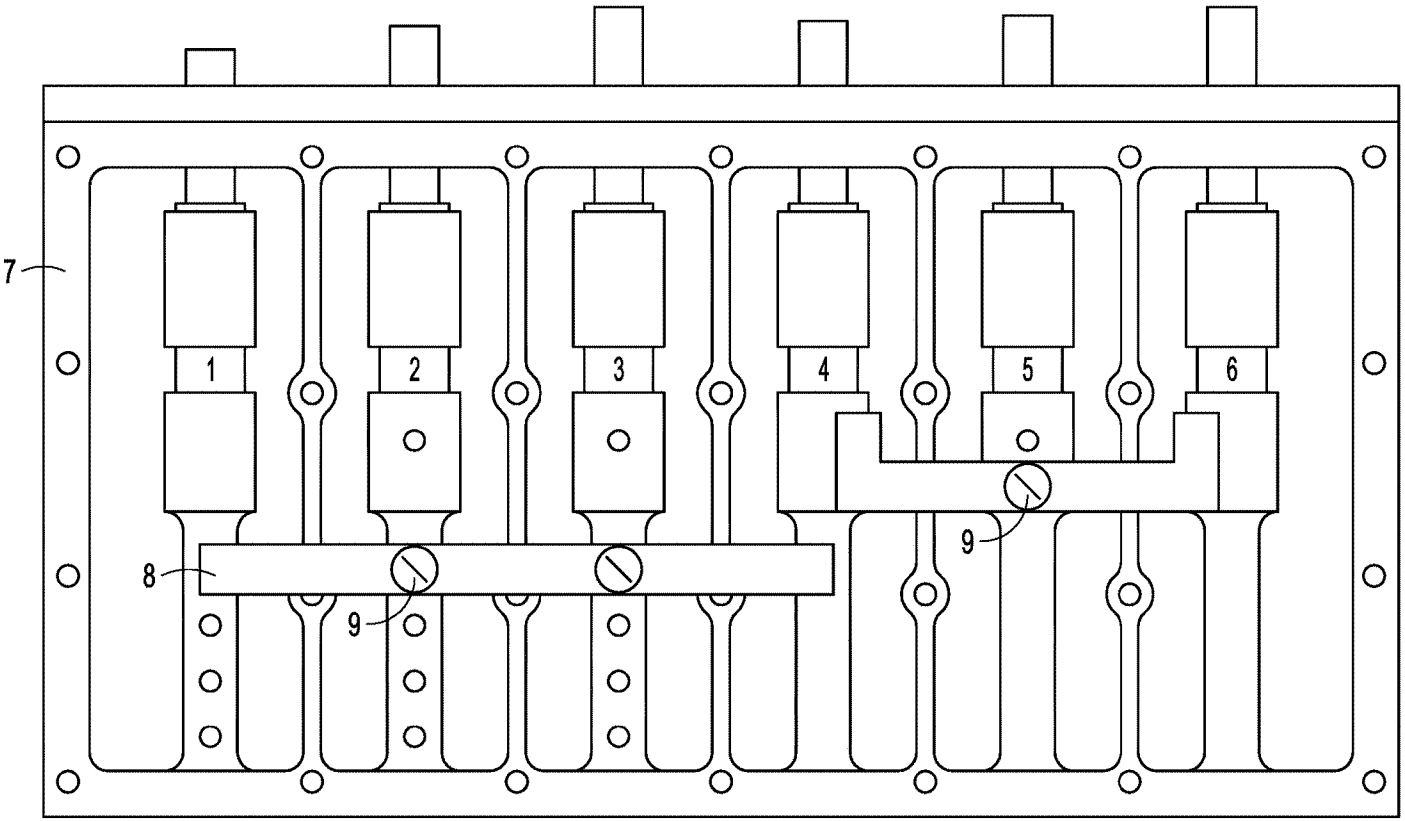
FIG. 2 is a front view of a multi resonator filter with a second embodiment of the coupling of the present invention showing the same set of six resonator cavities of FIGS. 1A and 1B with the coupling including two coupling elements.

A second embodiment of coupling 24 is shown in FIG. 2 for resonator filter 200. The resonator filter 20 includes the same six resonators 1-6 of FIGS. 1A and 1B. The coupling 24 also includes the coupling 12 of FIGS. 1A and 1B plus additional coupling element 26, which is a second metal strip coupling resonator 4 to resonator 6. For the geometry of the resonator filter 200 of FIG. 2, the measured coupling bandwidth values in frequency are:

Resonators 1~3=2.1 MHz
Resonators 1~4=3.3 MHz
Resonators 2~4=7.5 MHz The coupling bandwidth values for couplings 1~3 and 2~4 are also controllable by adjusting the spacing, i.e., making a thickness of the spacer 10 thicker or thinner so as to adjust the gap between the metal strip 8 and the surface 20 of the resonator cavity.

Figure 3:
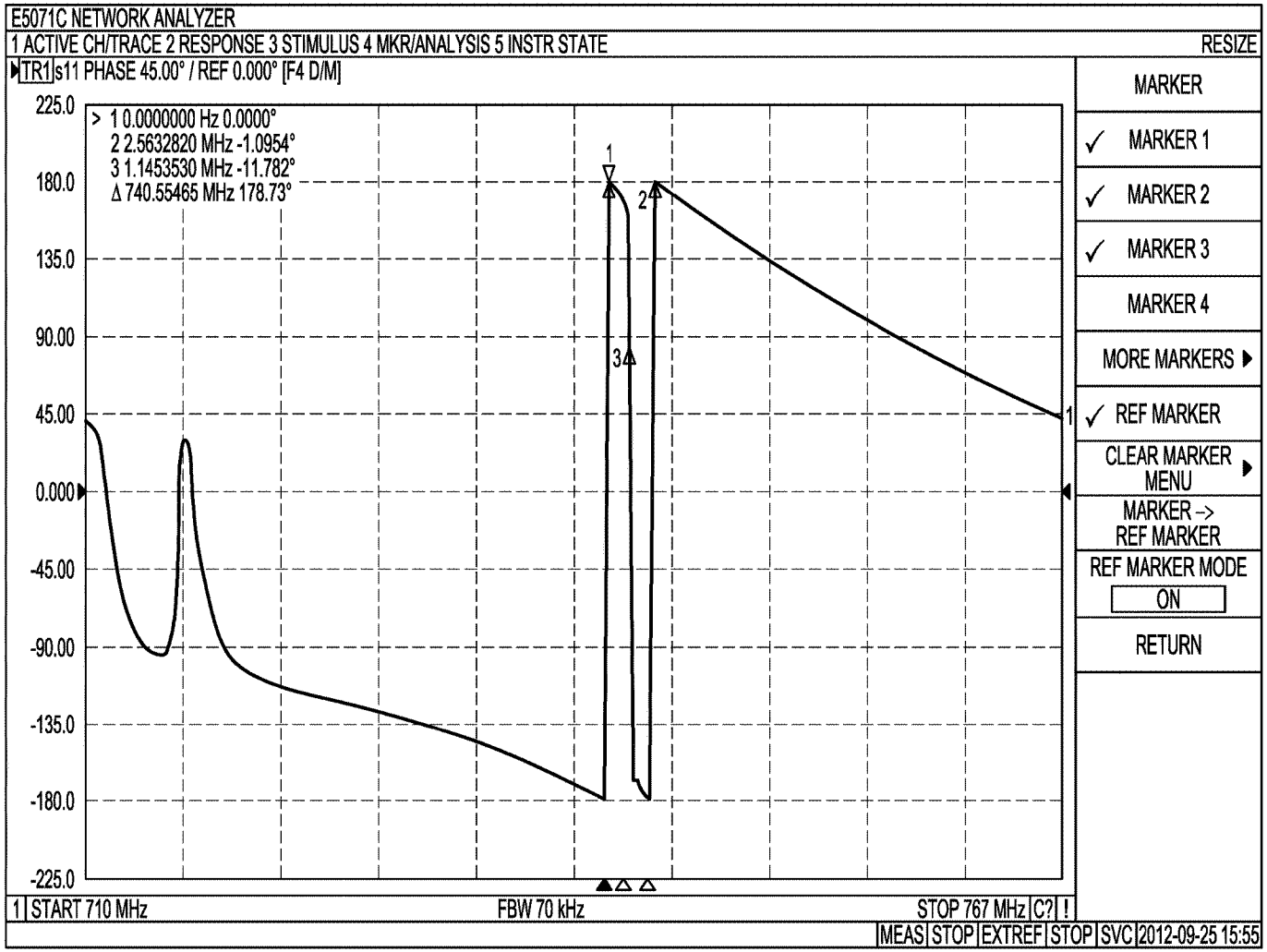
FIG. 3 is a graph showing the phase response from resonator 1 to resonator 3 of the resonator filter of FIG. 2.
Figure 4:
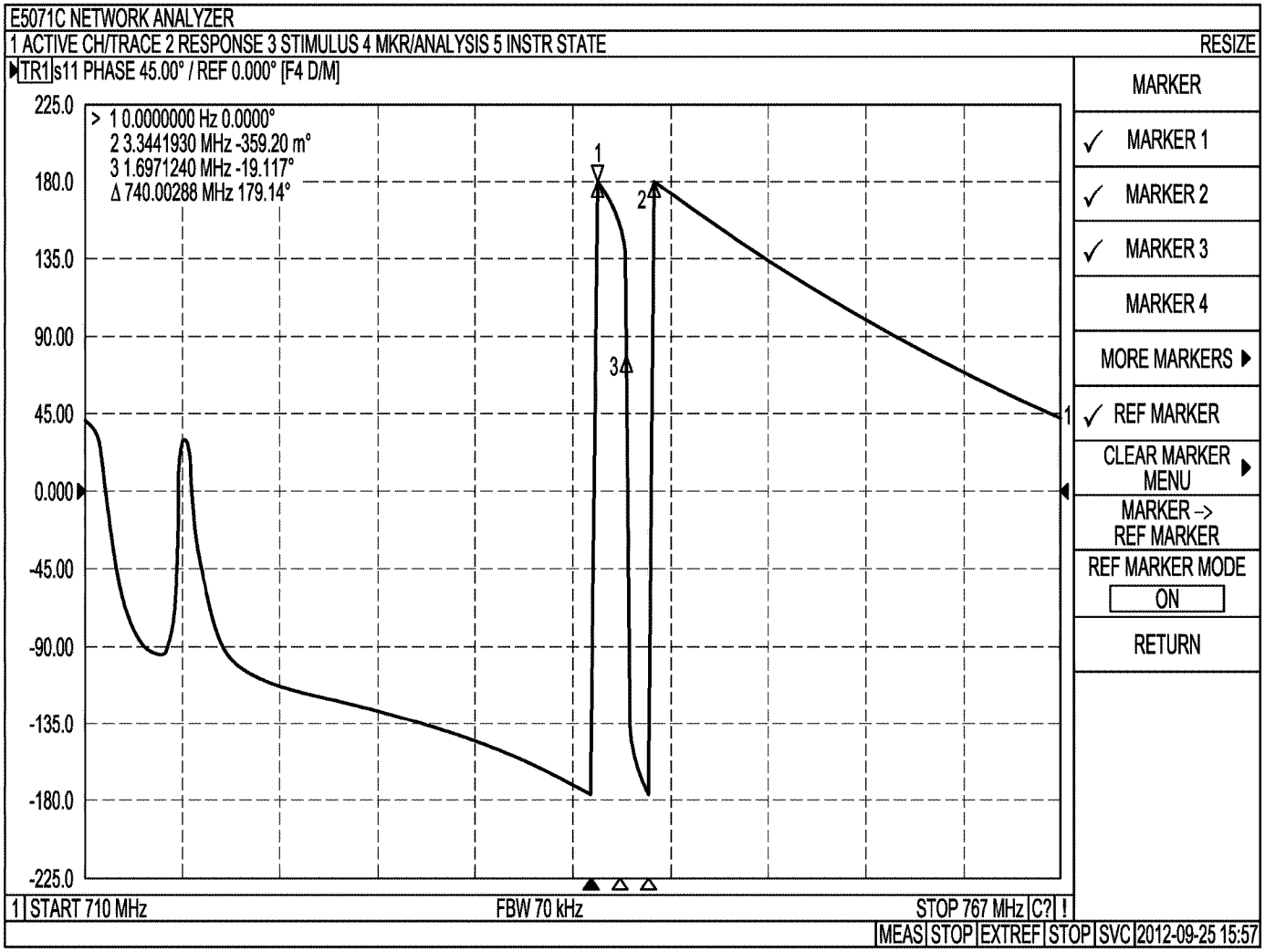
FIG. 4 is a graph showing the phase response from resonator 1 to resonator 4 of the resonator filter of FIG. 2.
Figure 5:
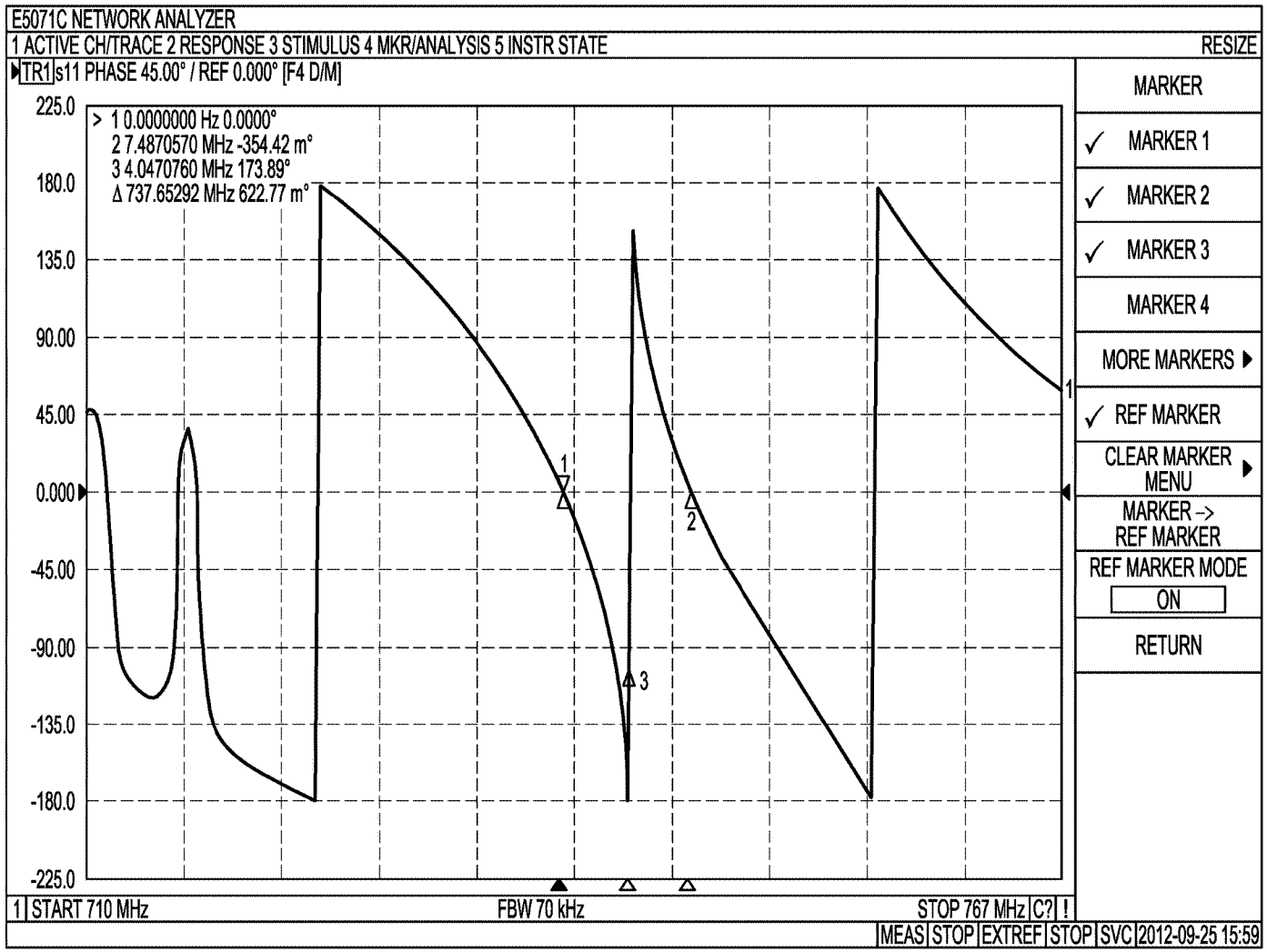
FIG. 5 is a graph showing the phase response from resonator 2 to resonator 4 of the resonator filter of FIG. 2.
Figure 6:
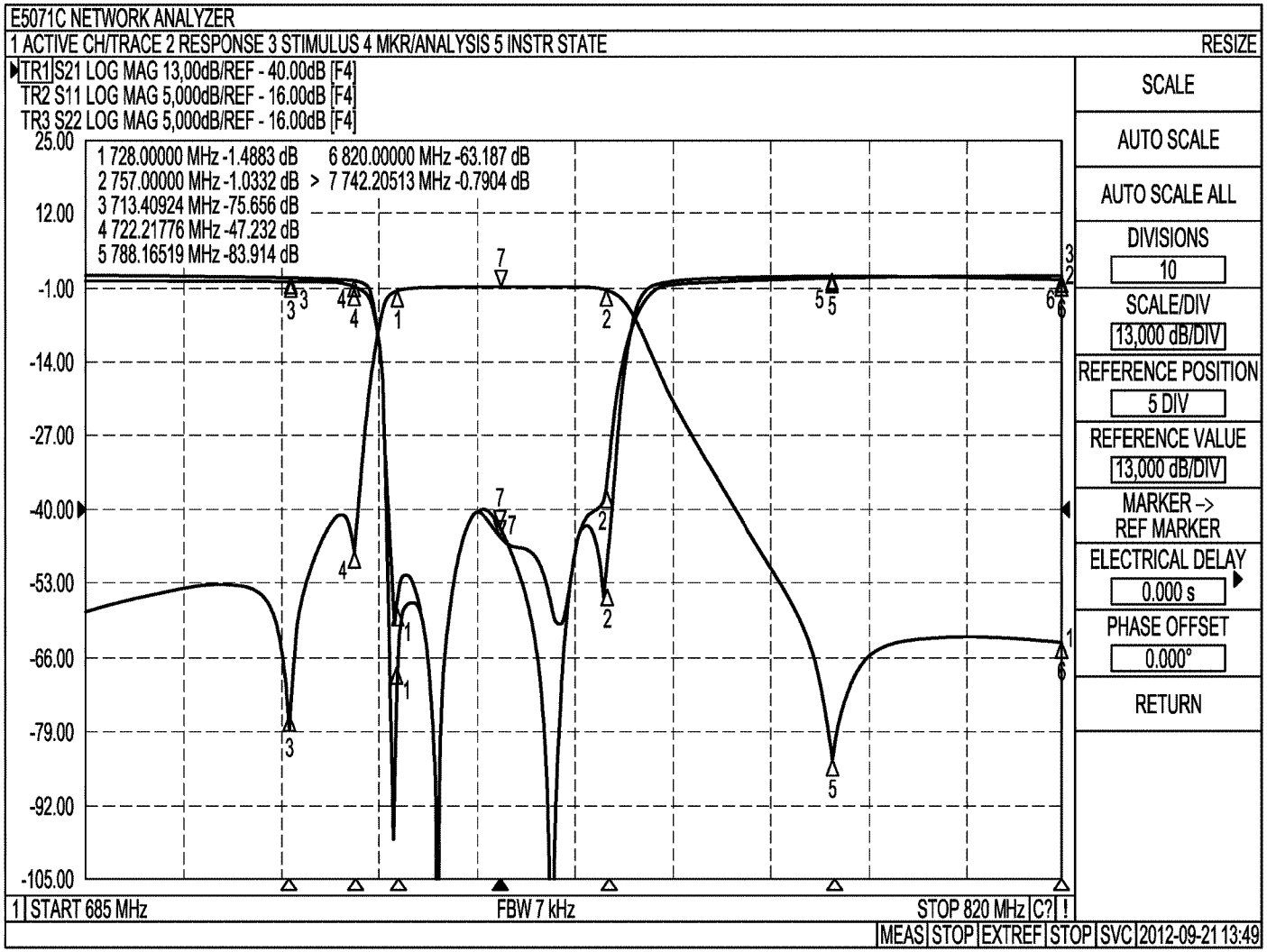
FIG. 6 is a graph showing the measured frequency response of the resonator filter of FIG. 2.

Measured phase responses for the coupling bandwidths of Resonators 1-3, 1-4 and 2-4 using the coupling 12 of FIGS. 1A and 1B and the corresponding coupling element of coupling 24, are given in FIGS. 3-5. FIG. 6 shows the output of a completely tuned filter of resonator filter 200 of FIG. 2, including the impact of the negative coupling between resonators 4 and 6 with coupling element 26. The plot of FIG. 6 clearly shows three transmission zeros.

The present invention has been described with reference to a specific embodiment hut is not intended to be so limited. The scope of the invention is defined by the appended claims.

What is claimed is:

1. A radio frequency (RF) filter, the RF filter comprising:
a plurality of resonators comprising a first, a second and at least a third resonator; and
a coupling contacting the first resonator and the second resonator without contacting the at least third resonator, wherein the first and the second resonators are not adjacent to one another, and wherein the coupling is connected via dielectric means to the at least third resonator positioned between the first and second resonators.

2. The RF filter of claim 1, wherein the coupling includes a metal strip in physical contact with a surface of the first resonator and a surface of the second resonator, and wherein the dielectric means includes a non-conductive spacer between the metal strip and a surface of the at least third resonator positioned between the first and second resonators.

3. The RF filter of claim 2, wherein a thickness of the non-conductive spacer is selectable.

4. The RF filter of claim 2, wherein the metal strip includes one or more tabs for contacting the first and second resonators.

5. The RF filter of claim 4, wherein lengths of the one or more tabs are selectable.

6. The RF filter of claim 2, wherein the metal strip couples a resonator cavity of the first resonator with a resonator cavity of the second resonator.

7. A radio frequency (RF) filter, comprising:
a plurality of resonators comprising a first resonator, a second resonator, a third resonator, a fourth resonator and a fifth resonator;
a first coupling contacting the first resonator and the second resonator without contacting the third, fourth and fifth resonators, wherein the first and the second resonators are not adjacent to one another, and wherein the first coupling is connected via first dielectric means to each resonator of the plurality of resonators that are positioned between the first and second resonators; and
a second coupling contacting the second resonator and the third resonator without contacting at least the first resonator, wherein the second and third resonators are not adjacent to one another, and wherein the second coupling is connected via second dielectric means to each resonator of the plurality of resonators that are positioned between the second and third resonators.

8. The RF filter of claim 7, wherein the first coupling includes a first metal strip in physical contact with a surface of the first resonator and a surface of the second resonator, wherein the first dielectric means includes a non-conductive spacer between the first metal strip and a surface of each resonator of the plurality of resonators that are positioned between the first and second resonators, wherein the second coupling includes a second metal strip in physical contact with the surface of the second resonator and a surface of the third resonator, and wherein the second dielectric means includes a second non-conductive spacer between the second metal strip and a surface of each resonator of the plurality of resonators that are positioned between the second and third resonators.

9. The RF filter of claim 8, wherein the non-conductive spacer and the second non-conductive spacer each have a thickness that is selectable.

10. The RF filter of claim 8, wherein the first metal strip includes one or more tabs for contacting the first and second resonators and the second metal strip includes additional one or more tabs for contacting the second and third resonators.

11. The RF filter of claim 10, wherein the one or more tabs and the additional one or more tabs have lengths that are selectable.

12. The RF filter of claim 7, wherein the first metal strip contacts the first and second resonators at a selectable location thereon, and the second metal strip contacts the second and third resonators at a selectable location thereon.

* * * * *